United States Patent [19]

Von Holdt

[11] 4,380,305

[45] Apr. 19, 1983

[54] MANUALLY REMOVABLE SEAL FOR BUCKETS AND CANS

[76] Inventor: John W. Von Holdt, 7430 N. Croname Rd., Niles, Ill. 60648

[21] Appl. No.: 329,258

[22] Filed: Dec. 10, 1981

[51] Int. Cl.[3] ..... B65D 41/16; B65D 41/18

[52] U.S. Cl. ..... 220/306; 220/281

[58] Field of Search ..... 220/281, 306, 307

[56] References Cited

U.S. PATENT DOCUMENTS

| | | | |
|---|---|---|---|
| 3,934,745 | 1/1976 | Lovell | 220/281 |
| 4,210,258 | 7/1980 | Von Holdt | 220/306 |
| 4,256,240 | 3/1981 | Woinarski | 220/306 |
| 4,293,080 | 10/1981 | Letica | 220/306 |
| 4,308,970 | 1/1982 | Von Holdt | 220/306 |

*Primary Examiner*—George T. Hall

*Attorney, Agent, or Firm*—Charles F. Pigott, Jr.

[57] ABSTRACT

A bucket lid made of flexible plastic defines a gripping channel for receiving the bucket, and an annular inner channel made of the wall of the lid, projecting outwardly relative to an attached bucket. Manual depression of a point of the inner channel with the finger causes the outer wall of the gripping channel to disengage a bucket lip retained in the gripping channel. This permits the lid to be peeled off of the bucket for opening.

8 Claims, 3 Drawing Figures

MANUALLY REMOVABLE SEAL FOR BUCKETS AND CANS

BACKGROUND OF THE INVENTION

In Von Holdt U.S. Pat. No. 4,210,258, plastic buckets for paint and the like are disclosed in which both the lid and the bucket may be made out of plastic, and have some flexibility. The lid defines an annular peripheral gripping channel for receiving and holding the bucket lid. While this design performs excellently in various of its forms as a reliable closure system for a flexible plastic bucket, improvements may be desired in the ease of opening of the container for use.

DESCRIPTION OF THE INVENTION

In accordance with this invention, an improved bucket lid is provided, being openable with the hands alone, and thus not necessarily requiring a screw driver or the like, as has been customary in conventional paint buckets.

The bucket lid of this invention is made of flexible plastic, and may be used in conjunction with either plastic or metal buckets as may be desired. The lid defines an annular, peripheral gripping channel for receiving and holding the lip of the bucket. The gripping channel defines respectively outer and inner walls, with the bucket lid also defining an annular inner channel defined by the wall of the lid, and projecting axially outwardly therefrom relative to an attached bucket. The inner channel is positioned radially inside of and adjacent the gripping channel.

As the result of this, manual depression of a point of the inner channel causes a corresponding portion of the outer wall of the gripping channel to flex outwardly to disengage the bucket lip retained in the gripping channel. This permits the lid to be peeled off of the bucket for opening.

The inner channel preferably defines an annular, straight outer wall which extends outwardly toward its junction with the gripping channel at an angle of typically 20° to 60° from the axis of a bucket attached to the lid, and typically no more than 45°. This straight outer wall serves as a lever arm as the point of the inner channel is depressed, transferring its force to the gripping channel, and causing a portion of the outer wall of the gripping channel to spread outwardly.

The inner wall of the gripping channel preferably joins the annular outer wall of the inner channel to define an annular apex which projects inwardly of the bucket lid toward the side facing the bucket attached thereto. This annular apex serves as a self-centering means to assist in centering of the bucket lid on a bucket during automated filling and closing processes. Particularly, it assists the filling operations of conventional paint filling machinery, with which the bucket of this invention may be used.

Specifically, the inner wall of the gripping channel may define an angle of 20° to 60° to the axis of the bucket attached to the lid, so that the annular apex defines angled, sloping sides to facilitate the self-centering characteristic, and typically no more than 45°.

Also, it is preferred for an annular retaining rib to project outwardly from the inner wall of the gripping channel into the space defined by the gripping channel to serve as a retention lock for the bucket lip.

Figure 1:
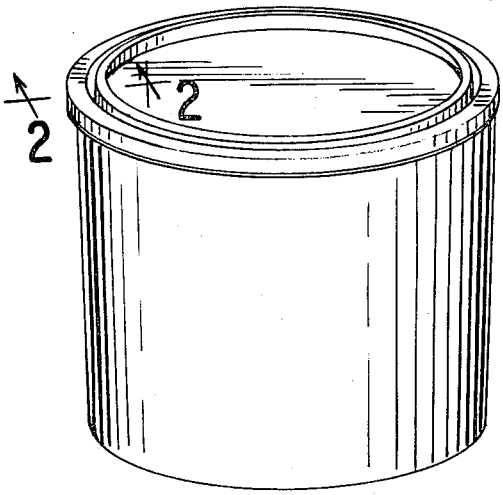
FIG. 1 is a perspective view of a bucket and lid in accordance with this invention.

Referring to the drawings, bucket 10 is shown carrying a flexible plastic lid 12 in accordance with this invention. Both bucket 10 and lid 12 may be made of a molded plastic such as a polyethylene or polypropylene-type semirigid plastic, but possessing some flexibility so that the lid is flexible enough to be manually peeled off of the bucket.

Figure 2:
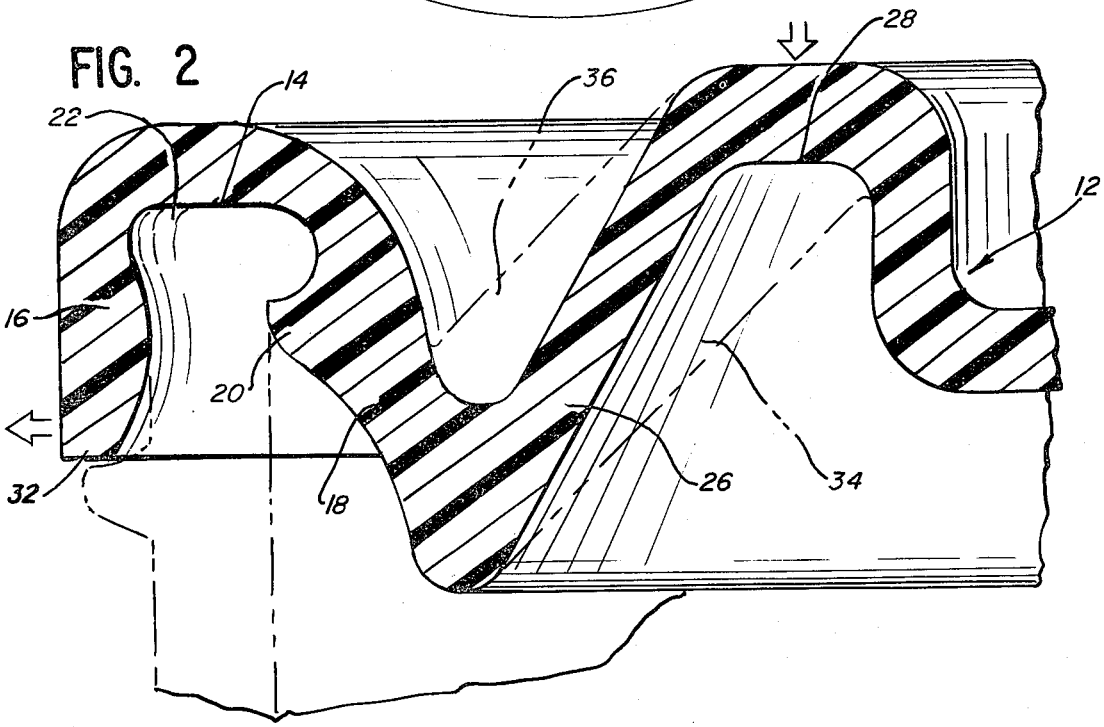
FIG. 2 is an enlarged, fragmentary sectional view of a portion of the bucket lid of this invention, shown in locking relationship with a bucket.

In FIG. 2, a peripheral portion of bucket lid 12 is shown in section. Annular peripheral gripping channel 14 is shown, being defined all around the circumference of lid 12 and of similar shape in all circumferential positions, defining outer wall 16 and inner wall 18 as part of the lid. Inner wall 18 also defines annular retaining rib 20 projecting outwardly into the space defined by gripping channel 14, for retention of bucket lip 22 as shown.

Inner wall 18 is shown to define an angle of preferably about 30° to the axis 24 of bucket 10 when attached to lid 12. Inner wall 18 joins annular outer wall 26 of annular inner channel 28, also defined by the wall material of lid 10, to define annular apex 30 which projects inwardly of the bucket lid toward the side facing a bucket 10 when attached thereto.

Annular outer wall 26 of inner channel 28 also defines an angle of about 30° to bucket axis 24, thus forming the annular apex described above, which assists in centering of the bucket lid on a bucket during automated filling and closing processes. The bucket lid can be placed upon the bucket, and the sloping surfaces of apex 30, particularly the sloping outer surface of annular wall 18, causes the lid to fall to the proper position for automated snap-closing of lid onto the bucket.

Inner channel 28, as shown, projects outwardly from lid 12 relative to an attached bucket.

Accordingly, one can depress a point or portion of inner channel 28 toward bucket 10 while lid 12 is carried on the bucket, with the result that inner wall 26 is flexed downwardly. The result of this is to cause transfer of forces thus generated to cause a corresponding portion of outer wall 16 to be flexed outwardly. One can then grip the lower edge 32 of outer wall 16 with the fingers, and pull a portion of it free from its retentive relationship with bucket lip 22. Lid 12, being flexible, can bend and be peeled off in a smooth and easy manner from bucket lip 22. For reapplication of lid 12 it can be merely snapped into place by one moving the fingers around the circumference of the lid to be sure all portions are snapped on lip 22.

If desired, radial ribs 34, 36 may be provided as shown, being spaced circumferentially about lid 12.

Figure 3:
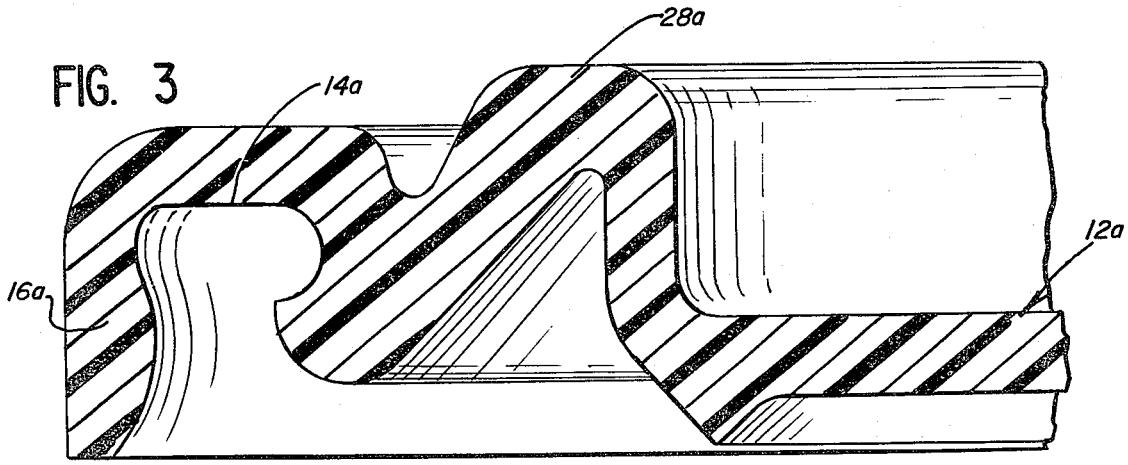
FIG. 3 is an enlarged, fragmentary sectional view of another embodiment of the bucket lid of this invention.

Referring to FIG. 3, a design which is substantially similar to that of FIG. 2, but different in certain proportions, is shown. Gripping channel **14*a* may be seen in lid 12*a*, with inner channel 28*a* being positioned more closely to gripping channel 14*a*, with a shorter outer wall 26*a*. As before, depression of inner channel 28*a* with a finger or the like causes a portion of outer wall 16*a* of gripping channel 14*a*** to flex outwardly, with the result that the lid can be peeled off with ease.

The above has been offered for illustrative purposes only, and is not intended to limit the scope of the invention of this application, which is as defined in the claims below.

That which is claimed is:

1. A bucket lid made of flexible plastic, said lid defining an annular, peripheral gripping channel for receiving and holding the lip of a bucket, said gripping channel defining an outer and inner wall, said bucket lid also defining an annular inner channel defined by the wall of the lid and projecting outwardly therefrom relative to an attached bucket, said inner channel being positioned radially inside of and adjacent said gripping channel, whereby manual depression of a point of said inner channel causes a portion of the outer wall of the gripping channel to disengage a bucket lip retained in said gripping channel, permitting the lid to be peeled off of the bucket for opening.

2. The bucket lid of claim 1 in which the inner channel defines an annular, straight outer wall which extends radially outwardly at an angle of 20° to 60° to the axis of a bucket attached to said lid toward junction with the gripping channel.

3. The bucket lid of claim 1 in which the inner channel defines an annular outer wall which joins the inner wall of the gripping channel, to define an annular apex which projects inwardly of the bucket lid toward the side facing a bucket attached thereto, whereby said apex assists to center the bucket lid on a bucket during automated filling and closing processes.

4. The bucket lid of claim 3 in which said inner wall of the gripping channel defines an angle of 20° to 60° to the axis of a bucket attached to said lid.

5. The bucket of claim 1 in which the inner wall of the gripping channel defines an annular retaining rib projecting outwardly into the space defined by said gripping channel.

6. A bucket lid made of flexible plastic, said lid defining an annular peripheral gripping channel for receiving and holding the lip of the bucket, said gripping channel defining an outer and inner wall, said bucket lid also defining an annular inner channel defined by the wall of the lid and projecting outwardly therefrom relative to an attached bucket, said inner channel being positioned radially inside of and adjacent said gripping channel, whereby manual depression of a point of said inner channel causes a portion of the outer wall of the gripping channel to disengage a bucket lip retained in said gripping channel, permitting the lid to be peeled off of the bucket for opening, said inner channel defining an annular, straight outer wall which extends radially outwardly at an angle of essentially 20° to 60° from the axis of a bucket attached to said lid toward junction with the gripping channel, the inner wall of the gripping channel and the outer wall of the inner channel defining at said junction an annular apex which projects inwardly of the bucket lid toward the side facing a bucket attached thereto, whereby said apex assists to center the bucket lid on a bucket during automated filling and closing processes.

7. The bucket lid of claim 6 in which the inner wall of the gripping channel defines an angle of essentially 30° to 45° to the axis of the bucket attached to said lid.

8. The bucket lid of claim 7 in which the inner wall of said gripping channel defines an annular retaining rib projecting outwardly into the space defined by said gripping channel.

* * * * *